United States Patent [19]

Martin

[11] 4,304,115

[45] Dec. 8, 1981

[54] METHOD FOR FORGING ROLLING MILL COUPLINGS

[75] Inventor: Wayne A. Martin, Wilkins Township, Allegheny County, Pa.

[73] Assignee: United States Steel Corporation, Pittsburgh, Pa.

[21] Appl. No.: 186,033

[22] Filed: Sep. 11, 1980

Related U.S. Application Data

[63] Continuation-in-part of Ser. No. 954,019, Oct. 23, 1978, abandoned.

[51] Int. Cl.[3] ..... B21D 22/00

[52] U.S. Cl. ..... 72/354; 72/359; 72/376

[58] Field of Search ..... 72/354, 359, 360, 374, 72/376

[56] References Cited

U.S. PATENT DOCUMENTS

| | | | |
|---|---|---|---|
| 1,373,726 | 4/1921 | Heiby et al. | 72/374 X |
| 1,841,920 | 1/1932 | Smith | 72/360 X |
| 2,663,205 | 12/1953 | Allen | 72/354 X |

*Primary Examiner*—Leon Gilden

*Attorney, Agent, or Firm*—William F. Riesmeyer, III

[57] ABSTRACT

A method and die assembly for forging a rolling mill coupling, the body of which has a socket in one end and tangs extending from the other end. The assembly comprises bottom and top punches which extrude metal downwardly from the bottom portion of a workpiece and upwardly from the top portion to form walls defining the socket at one end of the workpiece and tangs extending from the other end.

2 Claims, 4 Drawing Figures

METHOD FOR FORGING ROLLING MILL COUPLINGS

This is a continuation-in-part of my co-pending patent application Ser. No. 954,019, filed Oct. 23, 1978 now abandoned.

BACKGROUND OF THE INVENTION

This invention relates to an improved method and die assembly for forging rolling mill couplings.

A conventional rolling mill includes couplings fitted to wobblers at the ends of the rolls and connected to spindles which drive the rolls. A common form of coupling is a metal body which is approximately cylindrical in shape and of a diameter of about 16 to 60 inches. The coupling has a socket in one end, usually noncircular, to receive the wobbler and tangs extending from the other end for connection to a drive spindle. Most roll couplings are cast, since the machining operation required to form the coupling by and other means has been unduly difficult and costly.

An object of my invention is to provide an improved method and die assembly which enables me to form a roll coupling readily and conveniently in a forging operation, and produce a coupling needing very little machining.

A further object is to provide an improved forging method and die assembly in which I extrude metal from both the bottom and top portions of a workpiece in a single foring operation, as needed for example to form a socket in one end of a workpiece and tangs extending from the other end.

Figure 1:
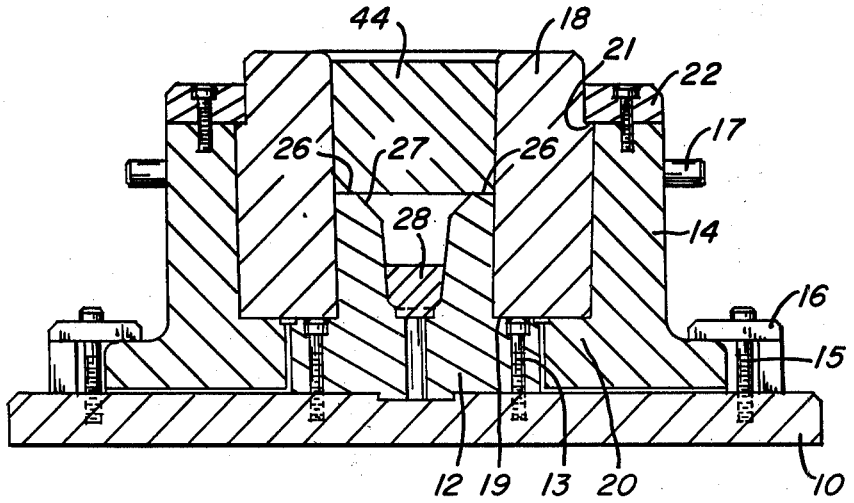
FIG. 1 is a vertical sectional view of the die assembly of my invention with a workpiece positioned therein to begin a forging operation.
Figure 2:
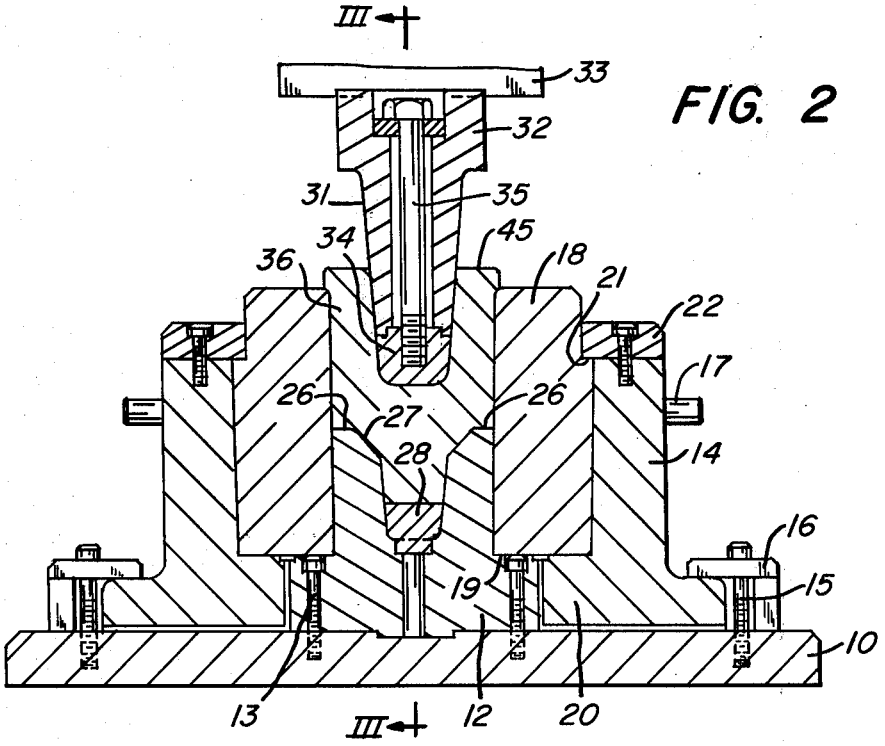
FIG. 2 is a vertical sectional view of the die assembly and workpiece at completion of the forging operation, the dies being of the semiclosed type.
Figure 3:
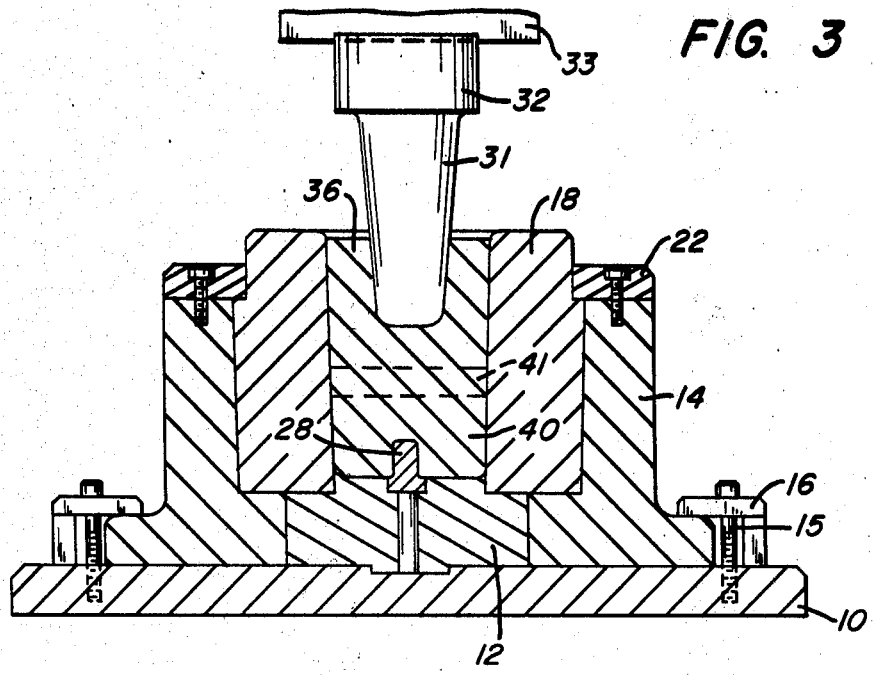
FIG. 3 is a vertical section on line III—III of FIG. 2.

As shown in FIGS. 1, 2 and 3, the preferred form of die assembly of the present invention includes a bolster plate 10, and a bottom punch 12 fixed to the bolster plate with bolts 13. A bottom die holder 14 is removably fastened to the bolster plate with bolts 15 and clips 16 and surrounds the bottom punch 12. The bottom die holder has lifting lugs 17 which project from its opposite sides. A tubular body insert 18 is received within the bottom die holder 14 and rests on an outwardly extending flange 19 on the bottom punch 12 and an inwardly extending flange 20 on the bottom die holder. Preferably the inside surface of the body insert has a slight downward taper in its upper portion extending from its upper edge to the level of the bottom punch 12. The insert has a shoulder 21 even with the top of the bottom die holder 14. A holddown ring 22 is bolted to the top of the bottom die holder and overlies shoulder 21.

The bottom punch 12 has a pair of upstanding arms 26. The upper confronting edges of the arms are rounded or beveled, as indicated at 27. A bottom punch insert 28 is fitted within the bottom punch 12 between arms 26 at their lower ends.

The assembly also includes a top punch 31 located above the bottom punch 12. In dies of the semiclosed type shown in FIGS. 2 and 3, the top punch has an enlarged upper section 32 which is of a diameter approaching the inside diameter of the body insert 18. The tip of the top punch is subject to greater heat and wear than the remainder of the assembly. As shown in FIG. 2, the tip preferably is formed of a separate piece 34 held in place by a bolt 35. The tip 34 is formed of a special die steel to withstand the more severe conditions. One example of a suitable steel is AISI H-12 which is reported to contain:

| | |
|---|---|
| C | 0.37% |
| Mn | 0.24% |
| P | 0.011% |
| S | 0.008% |
| Si | 1.00% |
| Cr | 4.97% |
| Mo | 1.44% |
| V | 0.20 |
| W | 1.37 |

Preferably the tip is heat-treated and tempered to a hardness of 36–40 Rockwell C. It should not be hardened beyond the latter limit, since it must also withstand shock. The remainder of the top die, as well as other components of the assembly, may be of any suitable alloy steel normalized and tempered to a hardness of 32–36 Rockwell C. The top punch is carried by a holder 33 which is attached to the crosshead of the press.

Figure 4:
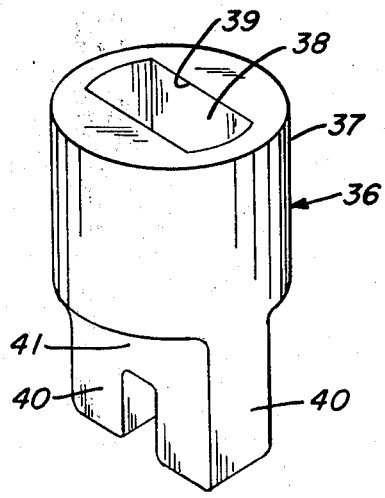
FIG. 4 is a perspective view of the forged roll coupling.

FIG. 4 shows a roll coupling 36 of the type which is forged in the die assembly of FIGS. 1, 2 and 3. The coupling has a body 37 which is approximately cylindrical but preferably has a small downward taper. A socket 38, usually noncircular, extends downwardly from the upper end of the body. The socket is illustrated as having flats 39 at two opposed sides but otherwise is circular. A pair of integral tangs 40 extend downwardly from a base 41 at the lower end of the body. When the coupling is installed in a rolling mill, the socket 38 receives the wobbler of a roll, and a drive spindle is connected to the tangs 40.

According to the forging method of the invention, a cylindrical metal workpiece 44, previously heated to a suitable forging temperature, is placed within the body insert 18 where it rests on the bottom punch 12, as shown in FIG. 1. The workpiece is of a size to provide a sufficient volume of metal for the coupling 32, and usually a small excess when the dies are of the semiclosed type. There is a small clearance between the sides of the workpiece and the body insert.

The top punch 31 is brought down against the workpiece 44, as shown in FIGS. 2 and 3. Metal from the bottom portion of the workpiece is extruded downwardly into the space between the arms 26 of the bottom punch 12 to form the base 41 for the tangs 40, as shown in FIG. 2. Additional metal is extruded downwardly from the base at opposite sides of the insert 28 to form the tangs themselves, as shown in FIG. 3. Metal from the upper portion of the workpiece is extruded upwardly around the top punch 31 to form the walls which define the socket 38. In the lower most position of the top punch the enlarged section 32 is spaced above the top of the body insert 18. The excess metal is extruded into the space between the body insert and the enlarged section, where it forms an irregular annular ridge 45.

On completion of the forging operation, the top punch 31 is withdrawn from the coupling. The coupling can be withdrawn from the body insert 18 by grasping the ridge 45 with a suitable tool and lifting the coupling from the body insert. The small downward taper of the body insert and coupling body facilitates such removal. Subsequently the ridge 45 is machined from the coupling.

From the foregoing description it is seen that my invention affords a simple method and die assembly for forging roll couplings which require that metal be extruded from both the bottom and top portions of the workpiece. The same basic parts can be used for forging couplings of a range of sizes, with changes of inserts and punches. The coupling as thus forged requires minimal machining to finish it for use. By forging and extruding the metal, the invention produces a coupling which has ideal flow lines from a guality standpoint. The coupling is more readily removed from the die assembly, and the quantity of metal in the workpiece need not be as carefully weighed. In closed die designs there is a tendency for metal flashings to be formed between the top punch and the body insert. Such flashings add to the difficulty in removing the coupling.

I claim:

1. A method of forging a roll coupling, said method comprising:

placing a heated approximately cylindrical metal workpiece in a bottom die assembly having a generally cylindrical first cavity for receipt of said workpiece and a second cavity therebeneath, bring a top punch down against the workpiece so as to extrude metal downwardly into said second cavity of the bottom die assembly to form a tang on said coupling, forming an annular ridge on said workpiece extending above the uppermost level of said first cavity in the bottom die assembly to facilitate removal of the workpiece from the bottom die assembly, said annular ridge having an upper surface formed exteriorly to said bottom die, and said top punch avoiding contact with said upper surface of said upper surface of said ridge during deformation.

2. The method of claim 1 wherein said workpiece initially does not extend above the uppermost level of said first cavity in the bottom die assembly, said method further including the step of extruding said workpiece upwardly to form a socket of the coupling and said annular ridge.

* * * * *